US008480949B2

(12) United States Patent
Kobayashi et al.

(10) Patent No.: US 8,480,949 B2
(45) Date of Patent: Jul. 9, 2013

(54) GAS-JET COOLING APPARATUS FOR CONTINUOUS ANNEALING FURNACE

(75) Inventors: Hirokazu Kobayashi, Tokyo (JP); Gentarou Takeda, Tokyo (JP); Hideyuki Takahashi, Tokyo (JP); Masato Sasaki, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/504,144

(22) PCT Filed: Oct. 27, 2010

(86) PCT No.: PCT/JP2010/069542
§ 371 (c)(1), (2), (4) Date: Apr. 26, 2012

(87) PCT Pub. No.: WO2011/052792
PCT Pub. Date: May 5, 2011

(65) Prior Publication Data
US 2012/0205842 A1 Aug. 16, 2012

(30) Foreign Application Priority Data
Oct. 27, 2009 (JP) ..... 2009-246043

(51) Int. Cl.
*F26B 7/00* (2006.01)

(52) U.S. Cl.
USPC ..... 266/111; 266/251

(58) Field of Classification Search
USPC ..... 266/103, 111, 251
See application file for complete search history.

(56) References Cited

U.S. PATENT DOCUMENTS 4,760,995 A * 8/1988 Fukuda et al. ..... 266/103
2012/0205842 A1 * 8/2012 Kobayashi et al. ..... 266/251

FOREIGN PATENT DOCUMENTS

JP 2005-146373 A 6/2005
JP 2006-144104 A 6/2006
JP 2007-277668 A 10/2007

* cited by examiner

*Primary Examiner* — Scott Kastler
(74) *Attorney, Agent, or Firm* — DLA Piper LLP (US)

(57) ABSTRACT

A gas-jet cooling apparatus for a continuous annealing furnace apparatus includes a plurality of tubular pressure headers extending in a width direction of a steel strip and having a length that is larger than a width of the steel strip, wherein the pressure headers are arranged to face each of front and back surfaces of the steel strip along a longitudinal direction of the steel strip at a pitch L; and a plurality of nozzles protruding from the pressure headers, wherein the nozzles are arranged along the width direction of the steel strip at a pitch W and arranged along the longitudinal direction of the steel strip in a staggered manner.

8 Claims, 6 Drawing Sheets

(a)

(b)

GAS-JET COOLING APPARATUS FOR CONTINUOUS ANNEALING FURNACE

RELATED APPLICATIONS

This is a §371 of International Application No. PCT/JP2010/069542, with an international filing date of Oct. 27, 2010 (WO 2011/052792 A1, published May 5, 2011), which is based on Japanese Patent Application No. 2009-246043, filed Oct. 27, 2009, the subject matter of which is incorporated by reference.

TECHNICAL FIELD

This disclosure relates to a gas-jet cooling apparatus for a continuous annealing furnace.

BACKGROUND

In a continuous annealing furnace, a process of continuously heating, soaking, cooling and, if necessary, over ageing a steel strip is performed. To provide a steel strip with desired characteristics, not only heating temperature and soaking time, but also uniform quenching of the steel strip is important. Development of high tensile steel used as an automobile material has progressed in recent years. To realize desired tensile strength, flexural characteristics, and elongation characteristics, processes for quenching a steel strip from an annealing temperature in the range of 900 to 800° C. to a temperature in the range of about 300 to 150° C. have been developed.

Various coolants are used to cool a steel strip. Depending on the selection of the coolant, the cooling speed of the steel strip varies.

Cooling can be performed at a high speed by using water as the coolant. However, the biggest problem with water cooling is that the shape of the steel strip changes due to quenching distortion. Moreover, because an oxide film is generated on the surface of the steel strip due to contact with water, it is necessary to provide equipment for removing the oxide film so that high economic efficiency and high productivity are unachievable.

There is a roll cooling method in which a coolant such as water is passed through a roller and a steel strip is cooled by making the steel strip contact a surface of the roller that has been cooled. With this method, a part of the steel strip does not contact the cooling roller when the steel strip is made to contact the cooling roller. Therefore, the steel strip may not be uniformly cooled in the width direction, and operational problems such as meandering and quality problems such as non-uniform quality frequently occur.

As another example, a cooling method using a gas as the coolant is also used. Although the cooling speed of this method is lower than those of the water cooling method and the roll cooling method described above, this method enables more uniform cooling in the width direction of a steel strip. To increase the cooling speed, which is the biggest problem with the gas cooling method, Japanese Unexamined Patent Application Publication No. 2005-146373 discloses an apparatus including a box-shaped header and long gas discharge nozzles attached to the header. The ends of the nozzles are disposed as close as possible to a steel strip, so that the heat transfer coefficient and the cooling speed are increased. Japanese Unexamined Patent Application Publication No. 2006-144104 discloses an apparatus that increases the cooling efficiency by using hydrogen.

However, the conventional technologies described have problems.

In the method described in JP '373, after the gas has been discharged from the nozzles, the gas flows along the steel strip or flows back toward the header. Retention of the gas easily occurs due to the presence of the box-shaped header. Therefore, the temperature of the furnace gas easily increases so that desired cooling performance is not obtained. It has been found that the higher the pressure of discharged gas is, the larger the influence of this phenomenon is. Moreover, there is a problem in that the temperature of the box-shaped header easily rises due to radiant heat received from the steel strip and thereby the total cooling performance is decreased. Furthermore, pressure loss is large because the lengths of the protruding nozzles are in the range of 150 to 200 mm, which are large. Therefore, it is necessary to use a powerful blower so that the power consumption is high, which is not preferable in terms of operation cost.

In the method of JP '104, a gas having a uniform hydrogen concentration (in the range of 20 to 80%) is introduced into the header. Because the temperature distribution in the width direction of the steel strip is not uniform due to influences of gas flow, a furnace wall, the header structure, and the like, the temperature distribution in the width direction does not become uniform if cooling is performed in the same manner in the width direction of the steel strip, and thereby the quality of the steel strip becomes non-uniform. Moreover, because fluttering of the steel strip occurs, the speed at which gas is discharged is limited (within the range of 100 to 190 m/s).

It could therefore be helpful to provide a gas-jet cooling apparatus for a continuous annealing furnace that reduces non-uniformity in the temperature distribution in the width direction of a steel strip, reduces fluttering of the steel strip when the gas is discharged at a high speed, and thereby realizes efficient cooling.

SUMMARY

We thus provide:

(1) A gas-jet cooling apparatus for a continuous annealing furnace includes a plurality of tubular pressure headers extending in a width direction of the steel strip and having a length that is larger than a width of the steel strip, the pressure headers being arranged to face each of front and back surfaces of a steel strip along a longitudinal direction of the steel strip at a pitch L; and a plurality of nozzles protruding from the pressure headers, the nozzles being arranged along the width direction of the steel strip at a pitch W and arranged along the longitudinal direction of the steel strip in a staggered manner. Positions of the pressure headers on the front and back sides of the steel strip are arranged to be displaced in the longitudinal direction of the steel strip such that a distance, in the longitudinal direction of the steel strip, between the pressure headers on the front side of the steel strip and the pressure headers on the back side of the steel strip is equal to or greater than ⅓ and equal to or smaller than ⅔ of the pitch L of the pressure headers in the longitudinal direction of the steel strip. The nozzles on the front and back sides of the steel strip are arranged to be displaced in the width direction of the steel strip such that a displacement amount, in the width direction of the steel strip, between the nozzles in a nozzle group on one of the front and back sides of the steel strip and the nozzles in a nozzle group on the other of the front and back sides of the steel strip is equal to or greater than 1/6 and equal to or smaller than 1/3 of the pitch W of the nozzles in the width direction of the steel strip.

(2) In the gas-jet cooling apparatus for a continuous annealing furnace according to (1), each of the pressure headers is segmented into three or more and seven or less segmented pressure headers in the width direction of the steel strip. A main header that supplies gas to the pressure headers is segmented into a number of segmented main headers that is the same as the number of the segmented pressure headers, each segmented main header supplying gas to one of the segmented pressure headers that is at the same position as the segmented main header with respect to the width direction of the steel strip. A header pressure of each segmented main header is independently adjustable.

(3) In the gas-jet cooling apparatus for a continuous annealing furnace according to (2), a gas that is introduced into the segmented main headers is an atmospheric gas of the continuous annealing furnace.

(4) In the gas-jet cooling apparatus for a continuous annealing furnace according to (3), an amount of the gas that is introduced into each segmented main header is adjustable, the gas being hydrogen gas or a nitrogen-hydrogen mixture gas including a hydrogen gas component that is equal to or greater than 30 volume percent.

(5) In the gas-jet cooling apparatus for a continuous annealing furnace according to any one of (1) to (4), each of the nozzles that protrude has a tapered structure such that an area of a bottom opening of the nozzle is larger than an area of an end opening of the nozzle, a taper angle thereof is equal to or greater than 4° and equal to or smaller than 30°, and a length of a protruding portion is equal to or greater than 20 mm and equal to or smaller than 120 mm.

Even if the gas is discharged from the nozzles at a high speed, retention of gas is prevented and circulation of gas in the cooling zone is promoted, whereby the cooling performance of the nozzles is maximally used and efficient cooling is achieved. Moreover, scratching of a steel strip due to fluttering and non-uniformity in the quality of the steel strip in the width direction are prevented, so that a steel strip having a uniform quality and a beautiful appearance can be produced.

REFERENCE SIGNS LIST

Figure 1:
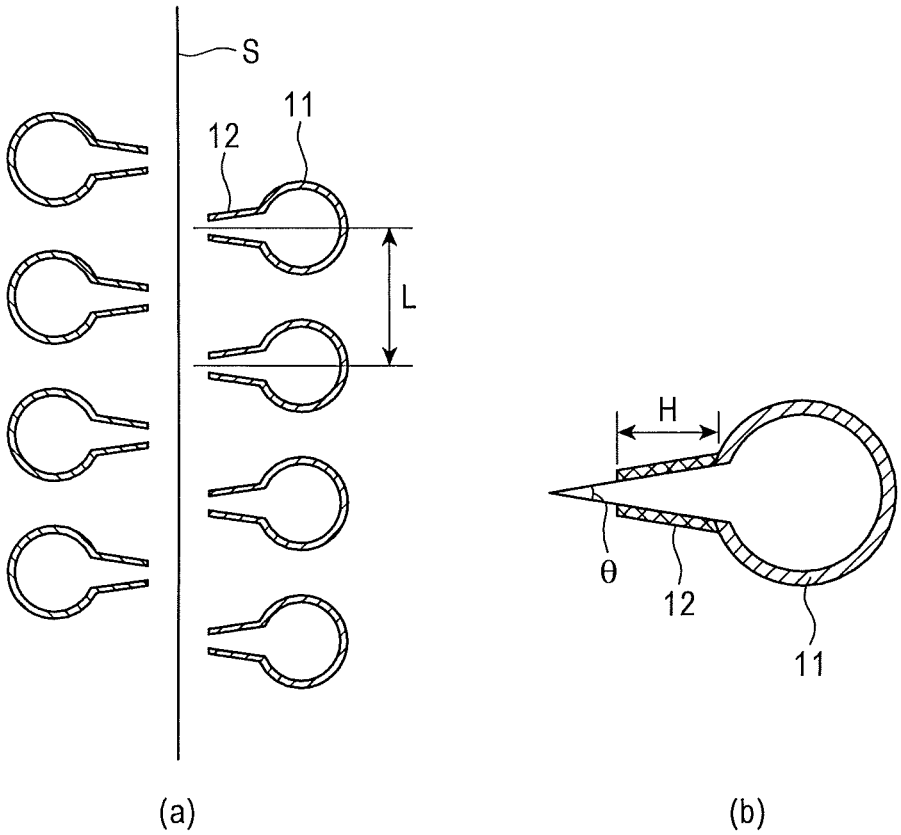
FIG. 1 is a longitudinal sectional view illustrating the arrangement of pressure headers and nozzles of a gas-jet cooling apparatus.

1 cooling zone
2 to 4 roller
5, 6 press roller
7 to 10 gas-jet cooling apparatus
11 pressure header
11-1 to 11-5 segmented pressure header
12 nozzle
13 to 16 blower fan
17 main header
17-1 to 17-5 segmented main header
18-1 to 18-5 atmospheric gas inlet pipe
19-1 to 19-5 high-concentration hydrogen gas inlet pipe
20-1 to 20-5,
21-1 to 21-5 mechanism for adjusting degree of opening or pressure
S steel strip

DETAILED DESCRIPTION

Referring to FIGS. 1 to 8, an example in which a gas-jet cooling apparatus is disposed in a cooling zone of a continuous steel strip annealing furnace will be described in detail. The percentage used to describe the composition of the furnace gas or a gas introduced into the pressure header and the like is volume percent.

Figure 3:
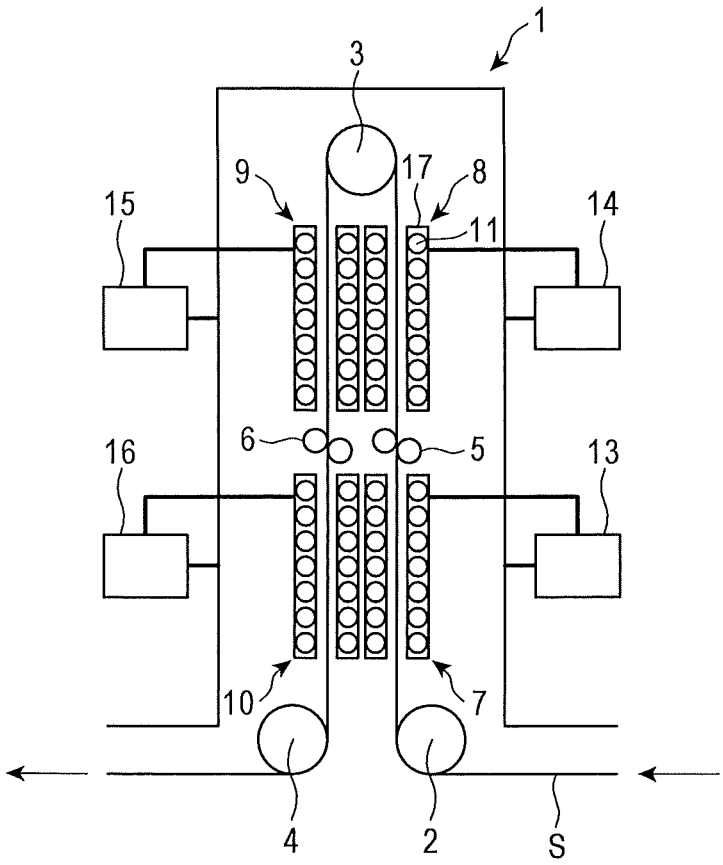
FIG. 3 is a longitudinal sectional view illustrating the main part of a cooling zone of a continuous steel strip annealing furnace including the gas-jet cooling apparatus.

FIG. 3 is a longitudinal sectional view illustrating the main part of a cooling zone of a continuous steel strip annealing furnace including a gas-jet cooling apparatus. FIG. 3 illustrates a cooling zone 1, rollers 2 to 4, press rollers 5 and 6, gas-jet cooling apparatuses 7 to 10, pressure headers 11, main headers 17, blower fans 13 to 16, and a steel strip S.

The cooling zone 1 includes a single temperature control zone or a plurality of temperature control zones. In this example, there are four temperature control zones, and the gas-jet cooling apparatuses 7 to 10 are disposed in respective zones.

A cooling gas (coolant) is blown by the blower fans 13 to 16 to the main headers 17 and then to the pressure headers 11.

FIG. 1 is a longitudinal sectional view illustrating the arrangement of the pressure headers 11 and nozzles 12 in the gas-jet cooling apparatus.

In the gas-jet cooling apparatuses 7 to 10, the pressure headers 11 are serially arranged along the movement direction of the steel strip on each of the front and back sides of the steel strip. The nozzles 12, which protrude from each of the pressure headers 11, are arranged along the width direction of the steel strip at a constant pitch on a side of the pressure headers 11 that face the steel strip. The pressure headers 11 have a tubular shape. The pressure headers 11 extend in the width direction of the steel strip and each have a length that is larger than the width of the steel strip.

A non-oxidizing cooling gas (such as $N_2$, $H_2$, or a mixture gas composed of these) is blown toward the steel strip S from the nozzles 12. The cooling gas is usually blown by using the blower fans 13 to 16. At this time, a furnace gas may be internally circulated or a gas may be drawn from the outside. In this cooling zone, a steel strip having a temperature in the range of about 900 to 600° C. after being annealed is usually cooled to a temperature in the range of about 550 to 200° C.

It is preferable that the nozzles 12 have a tapered protruding structure such that the area of the bottom opening of the nozzle is larger than the area of the end opening of the nozzle. By providing the nozzle with a tapered structure such that the area of the bottom opening of the nozzle is larger than the area of the end opening of the nozzle, pressure loss is reduced, a high discharge speed is obtained by using a compact nozzle, and decrease in the speed of gas after the gas has been discharged through the nozzle is reduced. It has been confirmed by an experiment that a good effect is obtained when the taper angle (θ: see FIG. 1) is equal to or greater than 4° and equal to or smaller than 30°. It is preferable that the protruding length (H: see FIG. 1) of the nozzle be equal to or greater than 20 mm and equal to or smaller than 120 mm. If the protruding length is smaller than 20 mm, the cooling effect is reduced due to accumulation of heat between the steel strip and the pressure header. If the protruding length is greater than 120 mm, the pressure loss is large and only a small amount of gas can be discharged. It is preferable that the protruding length be in the range of 40 to 100 mm.

Figure 2:
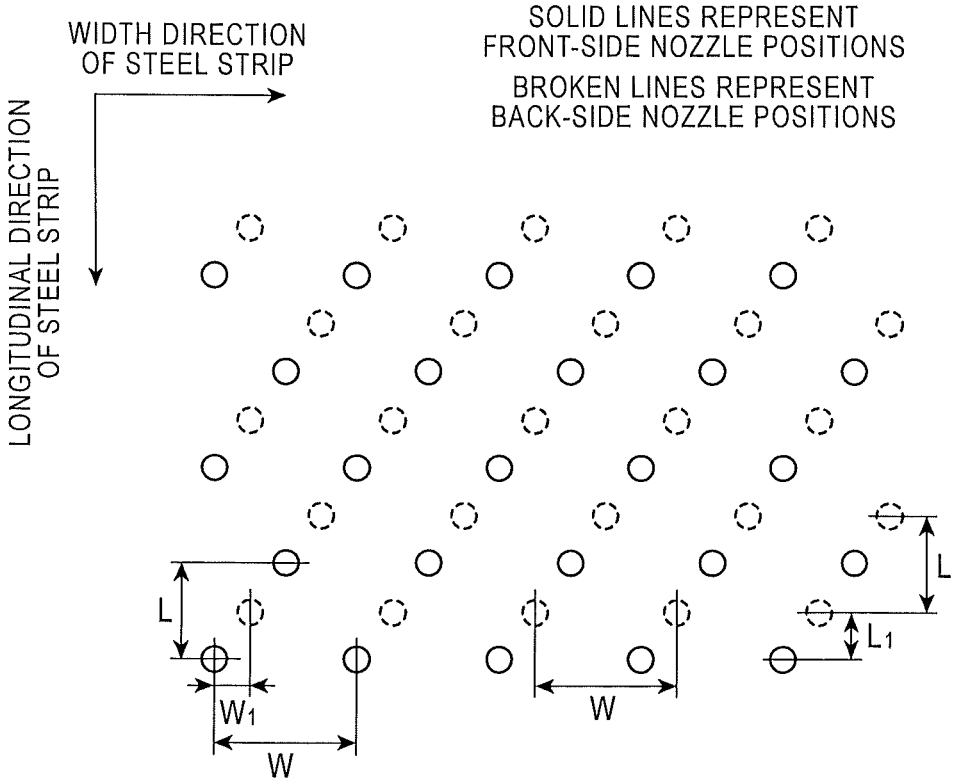
FIG. 2 is a front view illustrating the arrangement of openings of the nozzles.

FIG. 2 is a front view illustrating the arrangement of openings of the nozzles 12. The pressure headers 11 are arranged at a constant pitch L along the longitudinal direction of the steel strip on each of the front and back sides of the steel strip. Therefore, the nozzles 12 are also arranged at the constant pitch L along the longitudinal direction of the steel strip. Moreover, the nozzles 12 of each pressure headers 11 are arranged at a constant pitch W along the width direction of the steel strip.

On each of the front and back sides of the steel strip, the nozzles 12 are arranged in a staggered manner such that the positions of the nozzles 12 of one of the pressure headers 11 along the width direction of the steel strip are located between the positions of the nozzles 12 of the other one of the pressure headers 11 that is immediately upstream of the one of the pressure headers 11 in the longitudinal direction of the steel strip. That is, in the case of the front-side nozzle positions along the longitudinal direction of the steel strip illustrated by solid lines in FIG. 2, for example, the state in which the nozzles are "arranged in a staggered manner" refers to a state in which the nozzle positions immediately upstream in the longitudinal direction of the steel strip are displaced in the width direction of the steel strip to be located between the nozzles 12. Likewise, in the case of the back-side nozzle positions along the longitudinal direction of the steel strip illustrated by broken lines in FIG. 2, for example, the state refers to a state in which the nozzle positions immediately upstream in the longitudinal direction of the steel strip are displaced in the width direction of the steel strip to be located between the nozzles 12. It is generally known that the range on which a single nozzle acts is optimized and the cooling performance is high when the nozzles 12 are arranged in such a staggered manner.

Regarding such a nozzle arrangement, we found that vibration of the steel strip can be reduced if the pressure headers 11 on the front side of the steel strip and the pressure headers 11 on the back side of the steel strip are arranged to be displaced from each other in the longitudinal direction of the steel strip, i.e., if the nozzles 12 on the front side of the steel strip and the nozzles 12 on the back side of the steel strip are arranged to be displaced from each other in the longitudinal direction of the steel strip. Vibration of the steel strip is caused by a turbulent flow of gas discharged at a high speed from the nozzle, turbulence of an associated flow of gas that flows along a steel strip whose shape is unstable, or the like. On detailed examination of the condition for reducing the vibration of the steel strip, we found that the effect described above is produced if the positions of the pressure headers 11 on the front and back sides of the steel strip are displaced in the longitudinal direction of the steel strip such that a distance (L1 in FIG. 2), in the longitudinal direction of the steel strip, between the pressure headers on the front side of the steel strip and the pressure headers on the back side of the steel strip is equal to or greater than ⅓ and equal to or smaller than ⅔ of the pitch L of the pressure headers. If the displacement amount between the pressure headers on the front side of the steel strip and the pressure headers on the back sides of the steel strip in the longitudinal direction of the steel strip is smaller than ⅓ or greater than ⅔ of the pitch L of the pressure headers, the vibration reducing effect was not produced because the pitch between the nozzles on the front and back sides of the steel strip was too small.

Figure 4:
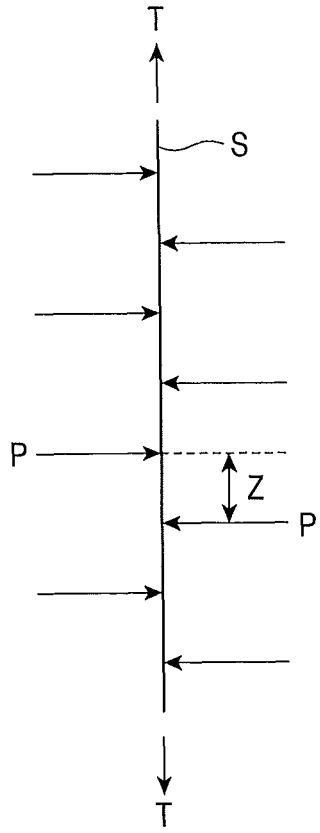
FIG. 4 is a conceptual diagram illustrating forces that are applied to a steel strip by a gas discharged from the gas-jet cooling apparatus.

It is assumed that this occurs due to the following mechanism. FIG. 4 is a conceptual diagram illustrating the relationship between forces that are applied to the steel strip due to the nozzles of the pressure headers of the gas-jet cooling apparatus. A rotation moment PZ acts on the steel strip and a force to bend the steel strip S in the longitudinal direction acts on the steel strip S, where P is a pressure generated when a gas collides with the steel strip S, T is the tension of the steel strip S, and Z is the distance between the nozzles that are located closest to each other in the longitudinal direction of the steel strip. Against the force to bend the steel strip, the tension T of the steel strip generates a restoring force to straighten the steel strip. It is assumed that the vibration is reduced by the restoring force.

Moreover, we found that non-uniformity in the temperature distribution is prevented and the steel strip is provided with uniform quality if the positions of the nozzles on the front and back sides of the steel strip are displaced in the width direction of the steel strip. Non-uniformity in the temperature distribution is reduced when the displacement amount (W1 in FIG. 2) between a nozzle group on one of the front and back sides of the steel strip and a nozzle group on the other of the front and back sides of the steel strip in the width direction of the steel strip is equal to or greater than ⅙ and equal to or smaller than ⅓ of the nozzle pitch W (see FIG. 2) in the width direction of the steel strip. If the displacement amount (W1 in FIG. 2) between the nozzles on the front side of the steel strip and the nozzles on the back side of the steel strip in the width direction of the steel strip is smaller than ⅙ or greater than ⅓ of the nozzle pitch W, the effect of making the temperature distribution uniform is not produced because the distance between the nozzles on the front and back sides of the steel strip is too large.

The cooling gas is introduced into the main headers 17 and then distributed from the main headers 17 to each pressure header 11. It is preferable each main header 17 be segmented into three or more and seven or less segmented main headers in the width direction of the steel strip and that each pressure header 11 be segmented into three or more and seven or less segmented pressure headers to correspond in number to the segmented main headers. The gas can be supplied from the segmented main headers to the segmented pressure headers that correspond to the segmented main headers in the width direction, i.e., that are located at the same positions with respect to the width direction. Moreover, the header pressure of each segment of the main header 17 can be adjusted.

Figure 5:
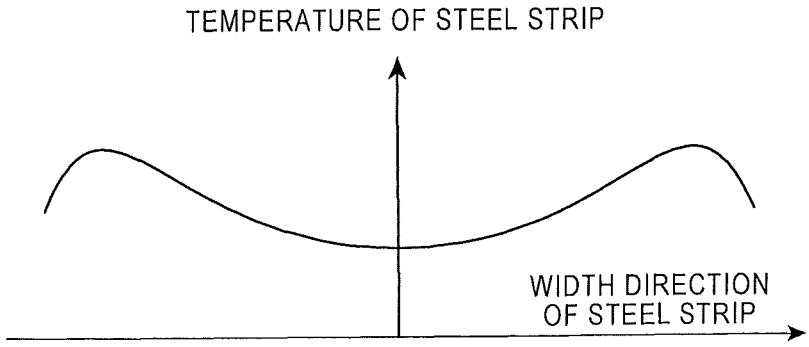
FIG. 5 is a schematic graph illustrating a temperature profile in the width direction of the steel strip when the steel strip is warped into a C-shape.

When the steel strip is warped and a cross-section of the steel strip is C-shaped in the width direction, i.e., when so-called "C-shaped warping" occurs, the steel strip has a temperature distribution in the width direction such that a middle part of the steel strip has a lower temperature as illustrated in FIG. 5, because the cooling gas is concentrated in the middle part of the steel strip. In this case, the temperature of the steel strip is adjusted as follows: the main header 17 is segmented in the width direction of the steel strip; the pressure header 11 is segmented in the width direction of the steel strip to correspond to the segmentation of the main header 17; the pressure of the main header 17 is adjusted in the width direction of the steel strip; and the amount of gas discharged from the pressure header 11 (header pressure) is changed in the width direction. If the number of segments of the header in the width direction of the steel strip is smaller than three, the temperature distribution cannot be made uniform. Although the temperature distribution was improved when the number of segments was increased up to seven, the temperature distribution was not improved further when the number of segments was larger than seven. Therefore, it is preferable that the number of segments be equal to or smaller than seven with consideration of the equipment cost.

The furnace gas in the cooling zone of the continuous annealing furnace can be used as a cooling gas that is introduced into the pressure headers 11. The hydrogen concentration of the furnace gas in the cooling zone is usually set in the range of about 5 to 20% to produce reducing atmosphere. The cooling performance can be improved by using a cooling gas having a hydrogen concentration higher than that of the furnace gas in the cooling zone. The hydrogen concentration of the cooling gas introduced into the pressure headers 11 can be increased by introducing a gas having a hydrogen concentration higher that of the furnace gas into the main header 17. The effect of improving the cooling performance is not produced if the hydrogen concentration of a gas that includes hydrogen gas with a concentration higher than that of the furnace gas in the cooling zone is lower than 30%. It is preferable that the gas introduced into the main header 17, which includes hydrogen gas with a concentration higher than that of the furnace gas in the cooling zone, be hydrogen gas or a nitrogen-hydrogen mixture gas including hydrogen gas with a concentration equal to or higher than 30 volume percent.

When the main headers 17 and the pressure headers 11 are each segmented in the width direction of the steel strip, uniformity in the temperature in the width direction of the steel strip can be improved further by allowing hydrogen gas or a nitrogen-hydrogen mixture gas having a hydrogen concentration equal to or higher than 30% to be introduced into each main header 17 and by allowing the flow rate of the gas to be adjusted.

Figure 6:
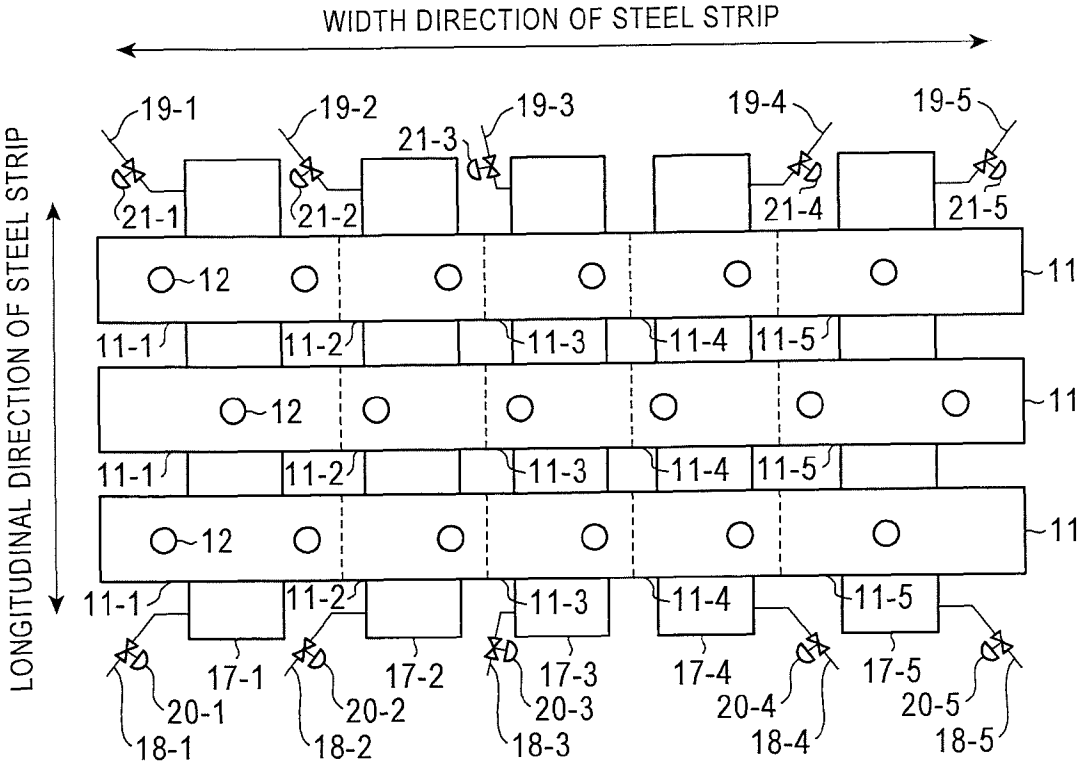
FIG. 6 illustrates a gas-jet cooling apparatus according to an example in which pressure headers are each segmented in the width direction of the steel strip, part (a) illustrating a front view and part (b) illustrating a side view.
Figure 6:
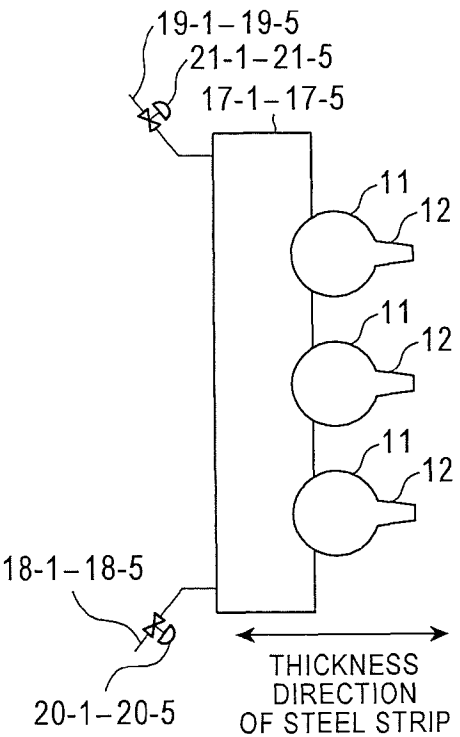

FIG. 6 illustrates a gas-jet cooling apparatus according to an example in which the main header and the pressure headers are each segmented into five segments in the width direction of the steel strip and that allows adjustment of the gas pressure and the amount of hydrogen gas for each of segmented headers, part (a) illustrating a front view and part (b) illustrating a side view. The pressure headers are disposed on each of the front and back sides of the steel strip. For convenience of description, FIG. 6 illustrates only three pressure headers on one of the sides.

In FIG. 6, each pressure header 11, on which nozzles are disposed, is segmented into five segments in the width direction of the steel strip as illustrated by broken lines. Segmented pressure headers 11-1 to 11-5 are formed by the segmentation. The segmented pressure headers of the pressure headers 11 are partitioned from each other. Segmented main headers 17-1 to 17-5, the number of which is the same as the number of the segments of the pressure header 11, are disposed behind the segmented pressure headers 11-1 to 11-5, respectively, and extend in the vertical direction. The segmented main headers 17-1 to 17-5 are connected to the groups of the segmented pressure headers 11-1 to 11-5, respectively.

Atmospheric gas inlet pipes 18-1 to 18-5 for introducing the furnace gas (atmospheric gas) in the cooling zone therethrough and high-concentration hydrogen gas inlet pipe 19-1 to 19-5 for introducing a gas including hydrogen gas with a concentration higher than that of the furnace gas therethrough are connected to the segmented main headers 17-1 to 17-5, respectively. The atmospheric gas inlet pipes 18-1 to 18-5 and the high-concentration hydrogen gas inlet pipes 19-1 to 19-5 respectively include mechanisms 20-1 to 20-5 and 21-1 to 21-5 for adjusting the degree of opening or the pressure. Regarding the segmented main headers 17-1 to 17-5, the internal pressure and the hydrogen concentration in each of the segmented main headers 17-1 to 17-5 can be adjusted by operating a corresponding one of the mechanisms 20-1 to 20-5 and 21-1 to 21-5 for adjusting the degree of opening or the pressure. The gas that has been introduced into the segmented main headers 17-1 to 17-5 is guided to the segmented pressure headers 11-1 to 11-5 that are connected to the headers, respectively.

By adjusting the internal pressure and the hydrogen concentration in each of the segmented main headers 17-1 to 17-5, the cooling performance of the pressure headers 11 in the width direction of the steel strip can be changed and the temperature distribution in the width direction of the steel strip can be adjusted.

In FIG. 6, the segmented pressure headers of the pressure headers 11 are partitioned from each other. However, partitions between the segmented pressure headers need not be formed. In this case, the temperature distribution in the width direction of the steel strip may be adjusted by changing one or both of the internal pressure and the hydrogen concentration in each of the segmented main headers 17-1 to 17-5 and thereby changing the cooling performance of the pressure headers 11 in the width direction of the steel strip.

The pressure headers and the main headers on the other one the front and back sides of the steel strip have structures the same as those described above. The main headers on the other side and the segmented main headers 17-1 to 17-5 that correspond in position to the main headers in the width direction are connected to each other through header pipes (not shown) that extend around a side edge of the steel strip. With such a structure, the effect described above is produced on the front and back sides of the steel strip.

Nozzles arranged in a staggered manner and having high cooling efficiency can be easily manufactured, in terms of the structure, by using a single large box-shaped header on which a plurality of nozzle rows can be arranged along the longitudinal direction as described in JP '373. However, because retention of gas between the steel strip and the box-shaped header easily occurs with this configuration, the temperature of the furnace gas tends to increase so that desired cooling performance cannot be achieved. It has been recognized that the higher the pressure of discharged gas (the larger the amount of gas) is, the larger the influence of this phenomenon is. Moreover, there is a problem in that the total cooling performance decreases because the temperature of the box-shaped header tends to increase due to radiant heat received from the steel strip.

Figure 7:
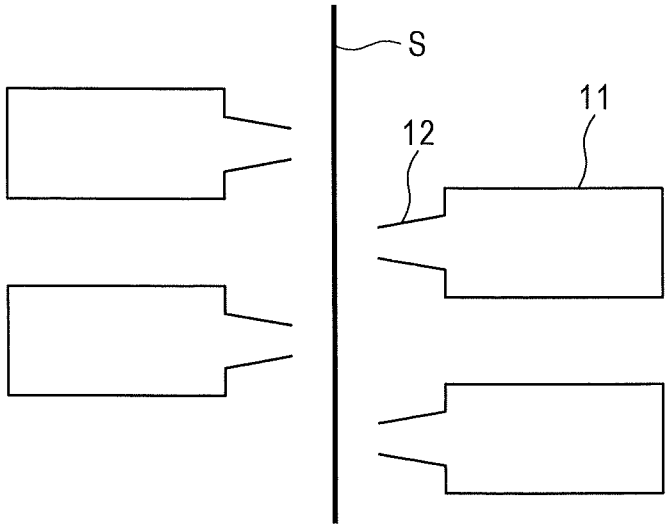
FIG. 7 is a longitudinal sectional view illustrating different sectional shapes of the pressure headers of the gas-jet cooling apparatus.
Figure 8:
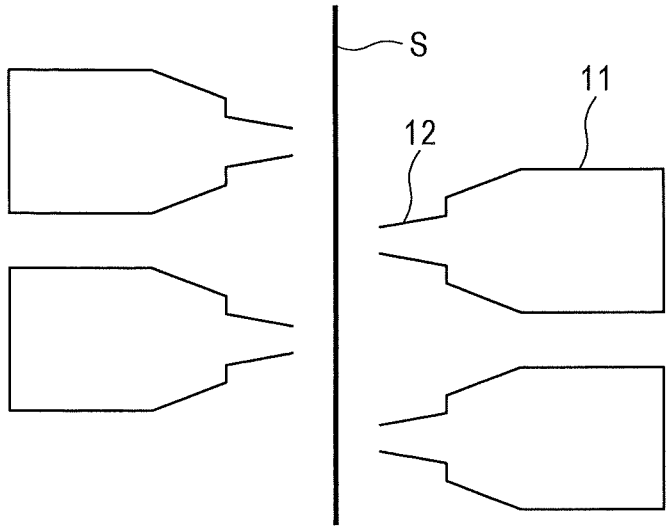
FIG. 8 is a longitudinal sectional view illustrating different sectional shapes of the pressure headers of the gas-jet cooling apparatus.

Therefore, the header structure is configured such that one nozzle row is disposed on one pressure header and the problem described above can be solved by changing the gaps between the pressure headers. However, if the sectional area of the pressure header is small, a non-uniform distribution of flow amount in the width direction tends to occur. Although this problem can be solved by segmenting the pressure header in the width direction of the steel strip, it is preferable that the pressure header has a large sectional area in the case where the pressure header is not segmented in the width direction of the steel strip. To increase the sectional area of the pressure header, it is not necessary that the sectional shape of the pressure header be circular. For example, as illustrated in FIGS. 7 and 8, the sectional area of the pressure header may be increased by providing the pressure header with a rectangular or trapezoidal sectional shape. The sectional shape of the header is not limited to these.

EXAMPLES

Gas-jet cooling apparatuses having the following specifications were set in a cooling zone disposed after a soaking zone of a hot dip zinc galvanizing line, and experiments of producing high tension steel strips were carried out.

Examples, Comparative Example

The gas-jet cooling apparatuses illustrated in FIGS. 1 to 3 were used.

- Pressure header: circular section having diameter of 50 A or equivalent, length 1750 mm
- Nozzle diameter: end opening ϕ20 mm, bottom opening ϕ28.8 mm, protruding height of nozzle: 50 mm
- Nozzle taper angle: 10.058°
- Distance between nozzles and steel strip: 100 mm
- Arrangement of nozzles in pressure header: 12 nozzles at pitch (W) of 140 mm
- Arrangement of pressure headers along longitudinal direction of steel strip: 65 rows at pitch (L) of 125 mm on each of front and back sides
- Number of segments of pressure header in width direction: 5.

The lengths of the segmented pressure headers at the middle position, at positions outside the middle position, and at edge sides were set at 560 mm, 280 mm, 315 mm, respectively, so that four nozzles were disposed on the segmented pressure header at the middle position, two nozzles were disposed on each of the segmented pressure headers at the positions outside the middle position, and two nozzles were disposed on each of the segmented pressure headers at the edge sides.

Regarding the nozzle groups having the structure described above and disposed on the front and back sides of the steel strip, the nozzle group on the back side of the steel strip was disposed to be displaced from the nozzle group on the front side of the steel strip in the longitudinal direction of the steel strip with a pitch (in the range of 31.25 mm to 62.5 mm) that is in the range of ¼ to ½ of the pitch (L) of the pressure headers in the longitudinal direction and to be displaced with a pitch (in the range of 20 mm to 35 mm) that is in the range of ⅐ to ¼ of the nozzle pitch (W) in the width direction of the steel strip.

- Number of cooling zones: 4

Conventional Art Example

Cooling nozzles according to the description in JP '373 were arranged as follows:

- Pressure header (cooling box): width 1700 mm×length 7000 mm (for one zone)
- Nozzle diameter: end opening ϕ20 mm, bottom opening ϕ40 mm
- Nozzle pitch in width direction: 40 mm
- Number of nozzles in width direction: 40
- Height of nozzle: 200 mm
- Nozzle pitch in longitudinal direction: 270 mm
- Number of nozzle rows in longitudinal direction: 25.

The nozzles were arranged such that the sum of the areas of the end openings of the protruding nozzles was in the range of 2 to 4% of the surface area of the cooling box.

- Segmentation in width direction of header: none
- Distance between nozzles and steel strip: 100 mm
- Number of pressure headers per one cooling zone: 1 (box shape)
- Number of cooling zones: 4

Table 1 shows the results obtained when a steel strip having a thickness of 1.4 mm and a width of 1400 mm was passed through the cooling equipment described above. The finish cooling temperature is a temperature measured at the exit side of the cooling zones. The maximum temperature deviation in the width direction is the maximum temperature difference in the width direction of the steel strip at the exit side of the cooling zones. The maximum amplitude of vibration of the steel strip is the maximum amplitude measured by using a laser displacement measurement device disposed in the middle of the fourth cool zone (No. 4 zone).

The cooling gas used in our Example and the Comparative Example was the atmospheric gas of the cooling zone, which was composed of 10% $H_2$ and $N_2$ for the remainder. The cooling gas was drawn in through an inlet port formed in the cooling zone, cooled by using a water-cooled gas cooler having metal pipes through which water flows, and supplied to the main headers by using blower fans. The gas that had been discharged from the nozzles of the pressure headers was drawn in through an inlet port formed in the cooling zone, and reused. In some of our Examples, hydrogen gas was supplied to the segmented main headers near on the edge sides of the steel strip through the high-concentration hydrogen gas inlet pipes connected to these headers.

In our Examples, the pressure of the gas supplied to each of the segmented main headers was adjusted to reduce the temperature difference in the width direction while monitoring the temperature distribution of the steel strip at the exit side.

In our Examples in which hydrogen gas was supplied, the hydrogen concentration, which was 10% at the start of the experiment, gradually increased during the experiment. At the end of the experiment, the hydrogen concentration was 17% for the case No. 1 and 18% for the case No. 2. The difference in the hydrogen concentration between the segmented main headers into which hydrogen gas was introduced and the segment main headers into which hydrogen gas was not introduced was small.

In the related art example, the atmospheric gas of the cooling zone, which was composed of 10% $H_2$ and $N_2$ gas for the remainder, was supplied to the pressure header. The gas that had been discharged through the nozzles of the pressure headers was drawn in again through an inlet port formed in the cooling zone, and reused.

The temperature of the gas discharged from the nozzles in zones near the No. 1 zone was high because the temperature of the steel strip was high and the amount of heat extraction was large. The temperature of the gas discharged from the nozzles in zones near the No. 4 zone was low. The temperature of discharged gas was in the range of about 110 to 50° C.

TABLE 1

| No | Displacement between nozzles on front and back sides in longitudinal direction of steel strip *1) | Displacement between nozzles on front and back sides in width direction of steel strip *2) | Segmented header pressure | | | Flow rate of supplied hydrogen | | | Concentration of supplied hydrogen |
|---|---|---|---|---|---|---|---|---|---|
| | | | Edge side | Between edge and middle | Middle | Edge side | Between edge and middle | Middle | |
| 1 | 1/2 | 1/4 | 3.0 kPa *3) | 3.0 kPa | 2.9 kPa | 0.8 $m^3$/min | — | — | 100% |
| 2 | 1/2 | 1/4 | 3.0 kPa *4) | 3.0 kPa | 3.0 kPa | 1.0 $m^3$/min | — | — | 100% |
| 3 | 1/2 | 1/4 | 3.0 kPa | 3.0 kPa | 2.8 kPa | — | — | — | — |
| 4 | 1/2 | 1/4 | 3.0 kPa | 3.0 kPa | 3.0 kPa | — | — | — | — |
| 5 | 1/3 | 1/6 | 3.0 kPa | 3.0 kPa | 3.0 kPa | — | — | — | — |
| 6 | 1/4 | 1/4 | 3.0 kPa | 3.0 kPa | 3.0 kPa | — | — | — | — |
| 7 | 1/2 | 1/7 | 3.0 kPa | 3.0 kPa | 3.0 kPa | — | — | — | — |
| 8 | 0 | 0 | Header pressure 3.0 kPa | | | — | — | — | — |

| No | Pressure changed in width direction of segmented header? | Hydrogen supplied to segmented headers? | Speed of strip | Start cooling temperature | Finish cooling temperature | Maximum temperature difference in width direction | Maximum amplitude of vibration of steel strip | Class |
|---|---|---|---|---|---|---|---|---|
| 1 | Yes | Yes | 120 m/min | 800° C. | 282° C. | 6° C. | 9 mm | Example |
| 2 | No | Yes | 120 m/min | 800° C. | 279° C. | 11° C. | 10 mm | Example |
| 3 | Yes | No | 120 m/min | 800° C. | 306° C. | 9° C. | 9 mm | Example |
| 4 | No | No | 120 m/min | 800° C. | 299° C. | 14° C. | 9 mm | Example |
| 5 | No | No | 120 m/min | 800° C. | 301° C. | 15° C. | 12 mm | Example |
| 6 | No | No | 120 m/min | 800° C. | 300° C. | 13° C. | 17 mm | Comparative Example |
| 7 | No | No | 120 m/min | 800° C. | 304° C. | 21° C. | 9 mm | Comparative Example |
| 8 | No | No | 120 m/min | 800° C. | 383° C. | 23° C. | 20 mm | Conventional Art Example |

*1) Ratio to pressure header pitch L in longitudinal direction of steel strip
*2) Ratio to nozzle pitch W in width direction of steel strip
*3) Hydrogen concentration in segmented header 10-17%
*4) Hydrogen concentration in segmented header 10-18%

In the Comparative Examples, the temperature of the steel strip at the exit side of the cooling zones was high, and non-uniformity in the temperature in the width direction of the steel strip and fluttering of the steel strip were large. In our Examples, the temperature of the steel strip at the exit side of the cooling zones was lower than that of the Conventional Art Examples by 80° C., and the non-uniformity in the temperature in the width direction of the steel strip and fluttering of the steel strip were reduced. In the Comparative Examples, although the temperature of the steel strip at the exit side of the cooling zones was lower that that of Conventional Art Examples, non-uniformity in the temperature in the width direction of the steel strip and fluttering of the steel strip could not be made small at the same time.

Industrial Applicability

With our gas-jet cooling apparatus, the cooling performance can be improved and non-uniformity in cooling can be prevented. Therefore, the gas-jet cooling apparatus can be used as a gas-jet cooling apparatus that is disposed in a cooling zone of a continuous annealing furnace.

The invention claimed is:

1. A gas-jet cooling apparatus for a continuous annealing furnace apparatus comprising:

a plurality of tubular pressure headers extending in a width direction of a steel strip and having a length that is larger than a width of the steel strip, wherein the pressure headers are arranged to face each of front and back surfaces of the steel strip along a longitudinal direction of the steel strip at a pitch L; and a plurality of nozzles protruding from the pressure headers, wherein the nozzles are arranged along the width direction of the steel strip at a pitch W and arranged along the longitudinal direction of the steel strip in a staggered manner, wherein positions of the pressure headers on the front and back sides of the steel strip are arranged to be displaced in the longitudinal direction of the steel strip such that a distance, in the longitudinal direction of the steel strip, between pressure headers on the front side of the steel strip and pressure headers On the back side of the steel strip is equal to or greater than ⅓ and equal to or smaller than ⅔ of the pitch L, of the pressure headers in the longitudinal direction of the steel strip, and wherein the nozzles on the front and back sides of the steel strip are arranged to be displaced in the width direction of the steel strip such that a displacement amount, in the width direction of the steel strip, between the nozzles in a nozzle group on one of the front and back sides of the steel strip and the nozzles in a nozzle group on another of the front and back sides of the steel strip is equal to or greater than ⅙ and equal to or smaller than ⅓ of the pitch W of the nozzles in the width direction of the steel strip.

2. The gas-jet cooling apparatus according to claim 1, wherein each of the pressure headers is segmented into three to seven segmented pressure headers in the width direction of the steel strip, wherein 1) a main header that supplies gas to the pressure headers is segmented into a number of segmented main headers that is the same as the number of the segmented pressure headers, 2) each segmented main header supplying gas to one of the segmented pressure headers that is at a same position as the segmented main header with respect to the width direction of the steel strip, and 3) a header pressure of each segmented main header is independently adjustable.

3. The gas-jet cooling apparatus according to claim 2, wherein a gas that is introduced into the segmented main headers is an atmospheric gas of the continuous annealing furnace.

4. The gas-jet cooling apparatus according to claim 3, wherein an amount of the gas introduced into each segmented main header is adjustable, the gas being hydrogen gas or a nitrogen-hydrogen mixture gas including a hydrogen gas component that is equal to or greater than 30 volume percent.

5. The gas-jet cooling apparatus according to claim 1, wherein each of the nozzles that protrude has a tapered structure such that an area of a bottom opening of the nozzel is larger than an area of an end opening of the nozzle, a taper angle thereof is equal to or greater than 4° and equal to or smaller than 30°, and a length of a protruding portion is equal to or greater than 20 mm and equal to or smaller than 120 mm.

6. The gas-jet cooling apparatus according to claim 2, wherein each of the nozzles that protrude has a tapered structure such that an area of a bottom opening of the nozzle is larger than an area of an end opening of the nozzle, a taper angle thereof is equal to or greater than 4° and equal to or smaller than 30°, and a length of a protruding portion is equal to or greater than 20 mm and equal to or smaller than 120 mm.

7. The gas-jet cooling apparatus according to claim 3, wherein each of the nozzles that protrude has a tapered structure such that an area of a bottom opening of the nozzle is larger than an area of an end opening of the nozzle, a taper angle thereof is equal to or greater than 4° and equal to or smaller than 30°, and a length of a protruding portion is equal to or greater than 20 mm and equal to or smaller than 120 mm.

8. The gas-jet cooling apparatus according to claim 4, wherein each of the nozzles that protrude has a tapered structure such that an area of a bottom opening of the nozzle is larger than an area of an end opening of the nozzle, a taper angle thereof is equal to or greater than 4° and equal to or smaller than 30°, and a length of a protruding portion is equal to or greater than 20 mm and equal to or smaller than 120 mm.

* * * * *